United States Patent [19]

Sun et al.

[11] Patent Number: 5,050,879

[45] Date of Patent: Sep. 24, 1991

[54] GOLF DRIVER WITH VARIABLE WEIGHTING FOR CHANGING CENTER OF GRAVITY

[75] Inventors: Donald J. C. Sun, San Diego, Calif.; Wen J. Tai, Kaohsiung, Taiwan

[73] Assignee: Cipa Manufacturing Corporation, Kaohsiung, Taiwan

[21] Appl. No.: 514,142

[22] Filed: Apr. 25, 1990

Related U.S. Application Data

[63] Continuation of Ser. No. 468,087, Jan. 22, 1990.

[51] Int. Cl.[5] ..... A63B 53/08

[52] U.S. Cl. ..... 273/80 A; 273/171; 273/172

[58] Field of Search ..... 273/167–175, 273/80 A

[56] References Cited

U.S. PATENT DOCUMENTS

| | | | |
|---|---|---|---|
| 1,598,050 | 8/1926 | Butchart | 273/174 |
| 2,163,091 | 6/1939 | Held | 273/171 |
| 2,328,583 | 9/1943 | Reach | 273/171 |
| 2,332,342 | 10/1943 | Reach | 273/171 |
| 3,143,349 | 8/1964 | Macintyre | 273/171 |
| 3,466,047 | 9/1969 | Rodia et al. | 273/171 |
| 3,556,533 | 1/1971 | Hollis | 273/171 |
| 3,652,094 | 3/1972 | Glover | 273/171 |
| 4,043,563 | 8/1977 | Churchward | 273/171 |

FOREIGN PATENT DOCUMENTS

| | | | |
|---|---|---|---|
| 440379 | 12/1935 | United Kingdom | 273/171 |
| 598543 | 2/1948 | United Kingdom | 273/171 |

OTHER PUBLICATIONS

"Ohio Golfer" Magazine, (May 1989 Issue), p. 17.

*Primary Examiner*—Edward M. Coven
*Assistant Examiner*—Sebastiano Passaniti
*Attorney, Agent, or Firm*—Edward A. Sokolski

[57] ABSTRACT

A golf club head has three cavities spaced along the sole of the head. A set of weight members having various weights is provided. Such weight members are selectively installed in the cavities to vary the center of gravity of the club head horizontally, between the toe and heel of the head to modify the driving action of the club as may be desired.

3 Claims, 1 Drawing Sheet

GOLF DRIVER WITH VARIABLE WEIGHTING FOR CHANGING CENTER OF GRAVITY

This application is a continuation in part of our application Ser. No. 468,087 filed Jan. 22, 1990.

BACKGROUND OF THE INVENTION

1. Field of the Invention

This invention relates to golf clubs and more particularly to a golf club driver head in which the center of gravity can be changed laterally to a desired point between the toe and heel of the club head to vary the driving characteristics thereof.

2. Description of Related Art

It is well known that the location of the center of gravity of a golf club head has a significant effect on the driving characteristics thereof, particularly with less skilled and experienced golfers. The expert can control the flight of the ball by controlled rotation of his hands to cause a spin or rotation to be imparted to the ball causing it to take a desired flight path. The less than expert golfer, however, is not able to exercise such control and generally relies on attempting to hit the ball so that impact with the club head is made at the "sweet spot" thereof which is generally located along a vertical line which runs directly opposite or through the center of gravity of the head. This tends to provide a straight shot without either "slice" (veering of the ball to the right) or "hook" (veering of the ball to the left).

The use of weights for properly locating the center of gravity of a golf club head is well known in the art as described, for example, in U.S. Pat. No. 3,72,887 issued Mar. 27, 1973 to Cochran, et al. The effects of changing the center of gravity of golf club head are also well known in the prior art. In prior art club heads such as described in U.S. Pat. No. 3,059,926 issued Oct. 23, 1962 to J. Johnstone, an entire set of clubs is provided, each being designed with a different center of gravity. Other prior art devices utilize weights which can be inserted in a club head for changing the weighting. No means is provided, however, in such prior art devices for precisely adjusting the center of gravity horizontally in a single club head to suit each golfer's individual requirements and to change this center of gravity as the golfer's experience and golfing habits change, as in the present invention.

SUMMARY OF THE INVENTION

The device of the present invention is a golf driver head having a plurality(in the preferred embodiment three) cavities formed in the sole of the club head. These cavities are spaced laterally along the sole. A plurality of weights which can be fitted into the cavities are provided. In the preferred embodiment such weights are all of approximately the same size but are of a different material having a different weight. Thus, typically a set of aluminum, zinc, tungsten, steel, brass, and lead weights is provided. The weights can be arranged in the cavities in a variety of different manners. It should be readily apparent that the center of gravity can be changed to different points between the toe and heel of the club head in increments with changes in the positioning of the various weights in the cavities.

It is therefore an object of this invention to provide a golf club head in which the center of gravity can be changed to different points between the toe and heel of the club head.

It is a further object of this invention to enable the center of gravity of a single golf club head to be changed horizontally to a great variety of locations to suit particular requirements of an individual golfer.

DETAILED DESCRIPTION OF THE INVENTION

Figure 1:
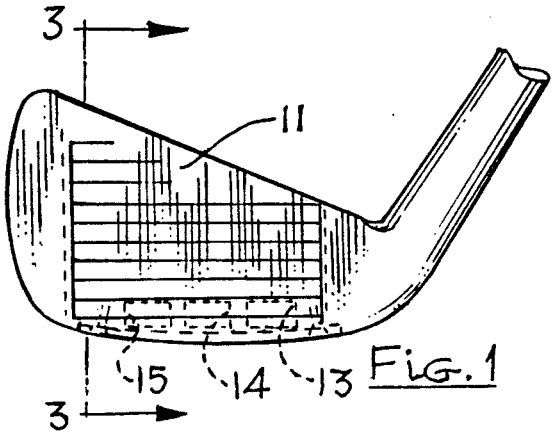
FIG. 1 is a front elevational view of a preferred embodiment of the invention.
Figure 3:
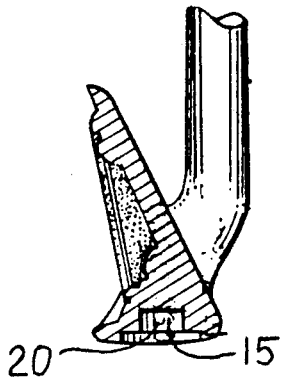
FIG. 3 is a cross sectional view taken along the plane indicated by 3—3 in FIG. 1.
Figure 4:
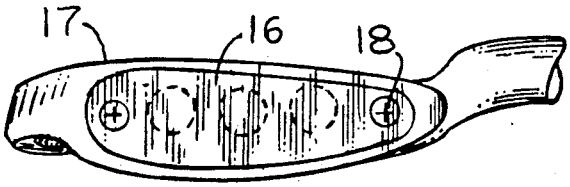
FIG. 4 is a bottom plan view of the preferred embodiment.
Figure 2:
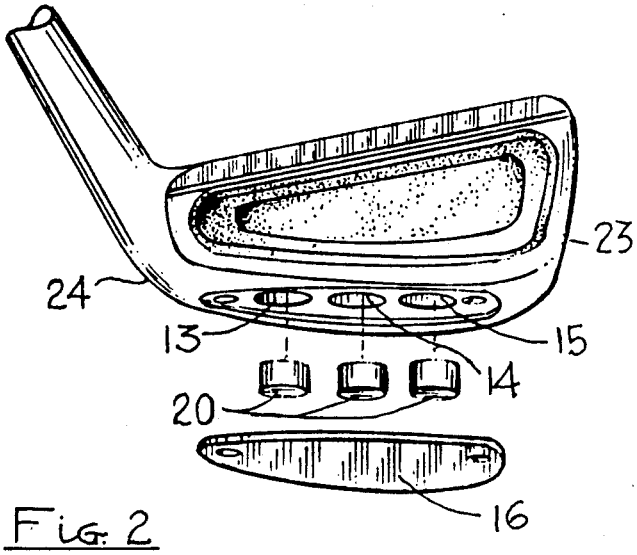
FIG. 2 is an exploded rear elevational perspective view of the preferred embodiment showing the weights removed from the chambers.

Referring now to the Figures, a preferred embodiment of the invention is illustrated.

The club head is made in a casting and has a face plate 11 which is affixed to such casting by suitable means such as welding. Formed in the casting in the sole portion 12 of the head are three cylindrical cavities 13, 14, and 15 which are arranged in a line and are spaced from each other along the longitudinal extent of the sole between the toe 23 and heel 24 of the head. In one embodiment of the invention, the center of the centrally located cavity 14 is located along the central plane of the striking face 11 which is along a line running through the center of gravity of the head with the centers of cavities 13 and 15 being equidistant from the center of cavity 14. A cover plate 16 for use in retaining the weight members 20 in the cavities is attached to the sole by means of screws 17 and 18. A plurality of cylindrical weight members 20 are provided, these weight members all being the same size. One of such weight members is installed in each of cavities 13–15. Such members are made of materials having different densities. Weights of weight members of different materials which may be employed with club heads having weights of 210–270 grams include: tungsten—6.80 gms; lead—4.00 gms; brass—3.00 gms; steel—2.70 gms; The weights and cavities typically have diameters of about 8 mm and depths or lengths of about 5 mm, but may vary between 7.5–10 mm in diameter and 4–6 mm in depth and length. The club head casting is typically made of stainless steel.

As noted above, a great variety of different combinations of the weights can be used to provide a great variety of different centers of gravity for the club head. Many permutations in the arrangement and combination of weights are available to obtain variations in the center of gravity with the set of weights described above. It is to be noted that weight members of the same weight may be used as part of a combination. To facilitate the use of the weights by the golfer, a table can ne provided to indicate the expected effects on slice and hook which will be influenced with various combined arrangements of the weights in the cavities to provide shifts in the center of gravity to the right and left. The shift in the center of gravity of the club head laterally from the center of the central cavity 14 can be calculated with the following equation:

$$\text{Shift in } CG = \frac{(Wt - Wh) \times d}{\text{Total Weight}} \quad (1)$$

where, Wt is the weight of the weight member closest to the toe of the head; Wh is the weight of the weight member closest to the heel of the head; d is the distance between the centers of cavities 13 and 14 and 14 and 15 which should be the same; and "Total Weight" is the total weight of the club head.

While the invention has been described and illustrated in detail, it is to be clearly understood that this is intended by way of illustration and example only and not by way of limitation, the scope of the invention being limited only by the terms of the following claims.

We claim:

1. In a golf club head having sole, toe and heel portions and a face plate, the improvement comprising:

three similarly dimensioned cavities including a central cavity, a cavity towards said toe portion, and a cavity towards said heel portion formed in said sole portion, said cavities being arranged in a line with adjacent cavities being spaced equidistantly from each other along said sole portion between the toe and heel portions, one of the ends of said cavities being open, a set of weight members, all of said weight members having the same dimensions which enables any one of said weight members to be fitted into any one of said cavities, some of the weight members of said set being of different density materials and different weights, cover plate means for removably covering the open ends of said cavities to retain the weights therein, said weight members being selectively installable in said cavities to provide a variety of different centers of gravity for said club head, the center of gravity being variably located horizontally between the toe and heel portions of said club head, said center of gravity being located at a position at the center of said central cavity when the weights of the weight members in the cavities towards the toe and heel portions are equal in weight to each other, the center of gravity being laterally shiftable from said position in accordance with a calculated value equal to the difference between the weight of the weight member in the cavity towards the toe portion and the weight of the weight member in the cavity towards the heel portion times the center to center distance between any two of the said adjacent cavities divided by the total weight of the club head.

2. The golf club head of claim 1 wherein said weight members are cylindrical in shape, said cavities having cylindrical inner surfaces with a diameter substantially equal to the outside diameter of said weight members.

3. The club head of claim 1 wherein the materials of said weight members are selected from the class consisting of tungsten, lead, brass, steel, zinc, and aluminum.

* * * * *